US009506692B2

(12) United States Patent
Petschauer et al.

(10) Patent No.: US 9,506,692 B2
(45) Date of Patent: Nov. 29, 2016

(54) DEVICE AND METHOD FOR DRYING FIBROUS MATERIAL

(75) Inventors: Franz Petschauer, Lannach (AT); Stefan Hansen, Graz (AT); Klaus Poeschl, Graz (AT)

(73) Assignee: ANDRITZ AG, Graz (AT)

( * ) Notice: Subject to any disclaimer, the term of this patent is extended or adjusted under 35 U.S.C. 154(b) by 670 days.

(21) Appl. No.: 13/881,251

(22) PCT Filed: Oct. 13, 2011

(86) PCT No.: PCT/AT2011/000425

§ 371 (c)(1),
(2), (4) Date: Apr. 24, 2013

(87) PCT Pub. No.: WO2012/054944

PCT Pub. Date: May 3, 2012

(65) Prior Publication Data

US 2013/0219739 A1 Aug. 29, 2013

(30) Foreign Application Priority Data

Oct. 27, 2010 (AT) ..... 1782/2010

(51) Int. Cl.

| | |
|---|---|
| ***F26B 5/14*** | (2006.01) |
| ***D21F 2/00*** | (2006.01) |
| ***D21F 3/02*** | (2006.01) |
| ***D21F 3/04*** | (2006.01) |
| ***D21F 9/00*** | (2006.01) |

(52) U.S. Cl.

CPC . *F26B 5/14* (2013.01); *D21F 2/00* (2013.01); *D21F 3/0254* (2013.01); *D21F 3/04* (2013.01); *D21F 9/003* (2013.01)

(58) Field of Classification Search

CPC ..... D21F 2/00; D21F 3/0254; D21F 3/04; D21F 9/003; F26B 5/14

See application file for complete search history.

(56) References Cited

U.S. PATENT DOCUMENTS 5,670,023 A * 9/1997 Steiner ..... D21F 3/0281 162/358.3
5,792,320 A 8/1998 Kaasalainen et al.

(Continued)

FOREIGN PATENT DOCUMENTS

| | | |
|---|---|---|
| AT | 412099 | 9/2004 |
| CN | 1198788 | 11/1998 |
| JP | 2002530547 | 9/2002 |

(Continued)

OTHER PUBLICATIONS

International Search Report for PCT/AT2011/000425, English translation attached to original, Both completed by the European Patent Office on Apr. 4, 2012, All together 5 Pages.

*Primary Examiner* — Jiping Lu
(74) *Attorney, Agent, or Firm* — Brooks Kushman P.C.

(57) ABSTRACT

A method for dewatering a fibrous material web, wherein fibrous material is applied via a headbox on at least one wire and is subsequently dewatered in order to form a fibrous material web. Following the wire section, the resulting fibrous material web is dewatered by several presses, wherein the first press through which the fibrous material web is guided following the headbox is equipped with a double nip. The first press is formed by a wire roll and two couch rolls which are each pressed against the wire roll for forming a nip. Also disclosed is a corresponding device for carrying out the method.

6 Claims, 2 Drawing Sheets

(56) References Cited

U.S. PATENT DOCUMENTS

| | | | | |
|---|---|---|---|---|
| 6,332,955 | B1 * | 12/2001 | Meschenmoser | D21F 3/0218 162/358.3 |
| 2013/0219739 | A1 | 8/2013 | Petschauer et al. | |

FOREIGN PATENT DOCUMENTS

| | | |
|---|---|---|
| WO | 9713030 | 4/1997 |
| WO | 9966122 | 12/1999 |
| WO | 2012054944 | 5/2012 |

* cited by examiner

DEVICE AND METHOD FOR DRYING FIBROUS MATERIAL

CROSS-REFERENCE TO RELATED APPLICATIONS

This application is the U.S. national phase of PCT Appln. No. PCT/AT2011/000425 filed on Oct. 13, 2011, which claims priority to AT Patent Application No. A 1782/2010 filed on Oct. 27, 2010, the disclosures of which are incorporated in their entirety by reference herein.

TECHNICAL FIELD

The subject matter of this invention is formed by a method for dewatering a fibrous web, fibrous material for the formation of a fibrous web being introduced via a headbox between two wire conveyors and being dewatered. Following the wire section, the fibrous web is guided through a plurality of presses and is dewatered.

The subject matter of the invention is also formed by a device for carrying out the method according to the invention.

BACKGROUND

A conventional device for dewatering fibrous material is disclosed in WO99/66122 in FIG. 1. In this device, a fibrous stock suspension is applied via a headbox to a wire conveyor, and a fibrous web is formed in the process. Following this, the fibrous web is dewatered by a first press, what is known as the "lump breaker". This press has a nip which is formed by a wire roll and by a couch roll. Here, the couch roll is wrapped around by a felt.

The problem with this press is that the felt is overloaded at high production speeds and pressing of the web occurs.

SUMMARY

The invention is therefore based on the object of providing a method with a "lump breaker" or a first press, in which sufficient dewatering of the fibrous web can take place even at high production rates.

This object is achieved by a dewatering method, in which the first press, through which the fibrous web is guided after the headbox, is equipped with a double nip. Here, the first press is formed by a wire roll and by two couch rolls which are in each case pressed against the wire roll in order to form a nip. The wire roll is wrapped around by a wire conveyor and the couch rolls are wrapped around in each case by a felt. A considerable improvement in the dewatering performance of the first press can be achieved by the double nip of the "lump breaker".

It is advantageous if the couch rolls are wrapped around by a common felt. It is also appropriate here if the felt is dewatered between the first and the second nip by way of a tubular suction device, in order that the felt runs into the second nip in a state in which it is dry again.

In one favorable embodiment, the fibrous web is transferred without a loose run from the first press into a following shoe press, the web transfer being carried out with the aid of a suction roll or a grooved roll.

Moreover, it is favorable if the fibrous web is heated between the first and the second nip of the first press by a steam blower box. The viscosity of the water which is contained can be modified by the heating of the moist fibrous web, as a result of which the dewatering in the second nip is aided.

The subject matter of this invention is also formed by a corresponding device for carrying out the method.

BRIEF DESCRIPTION OF THE DRAWINGS

In the following text, the invention will be described using drawings, in which.

Identical designations in the respective figures denote identical components.

DETAILED DESCRIPTION

Figure 1:
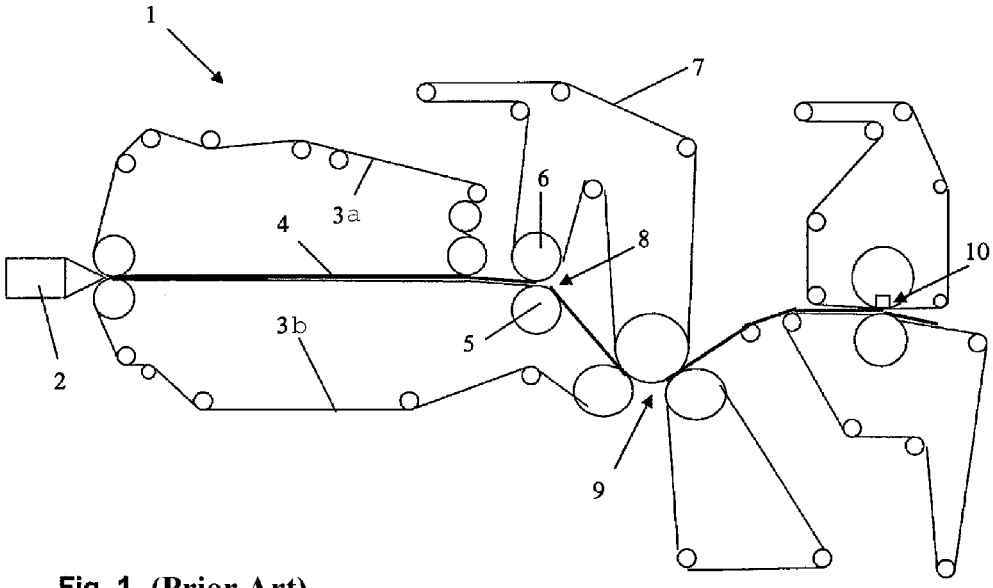
Fig. 1 (Prior Art)
FIG. 1 shows a conventional dewatering device according to the prior art.

FIG. 1 shows a dewatering device 1 according to the prior art. The fibrous stock suspension is sprayed in between the wire conveyors 3*a* and 3*b* of the wire section by a headbox 2. As a result, a fibrous web 4 is formed which is dewatered in a first press 8, what is known as the "lump breaker". Said first press 8 comprises a wire roll 5 and couch roll 6, the couch roll being wrapped around by the felt 7. The felt 7 is overloaded at high production speeds, and the dewatering of the fibrous web 4 is then no longer satisfactory.

Further presses 9 and 10, by way of which the fibrous web 4 can be dewatered further, are arranged downstream of the first press 8.

Figure 2:
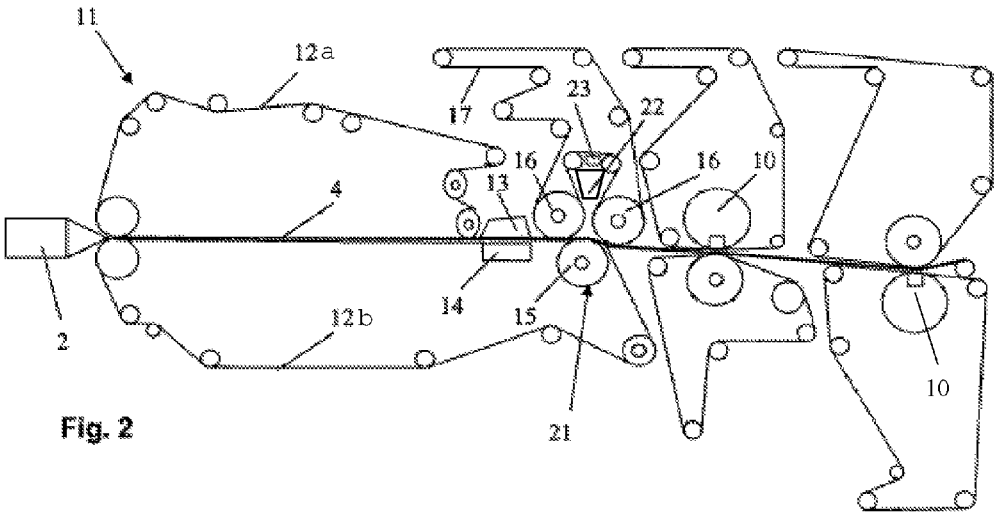
FIG. 2 shows a diagrammatic illustration of the dewatering device according to the invention.
Figure 3:
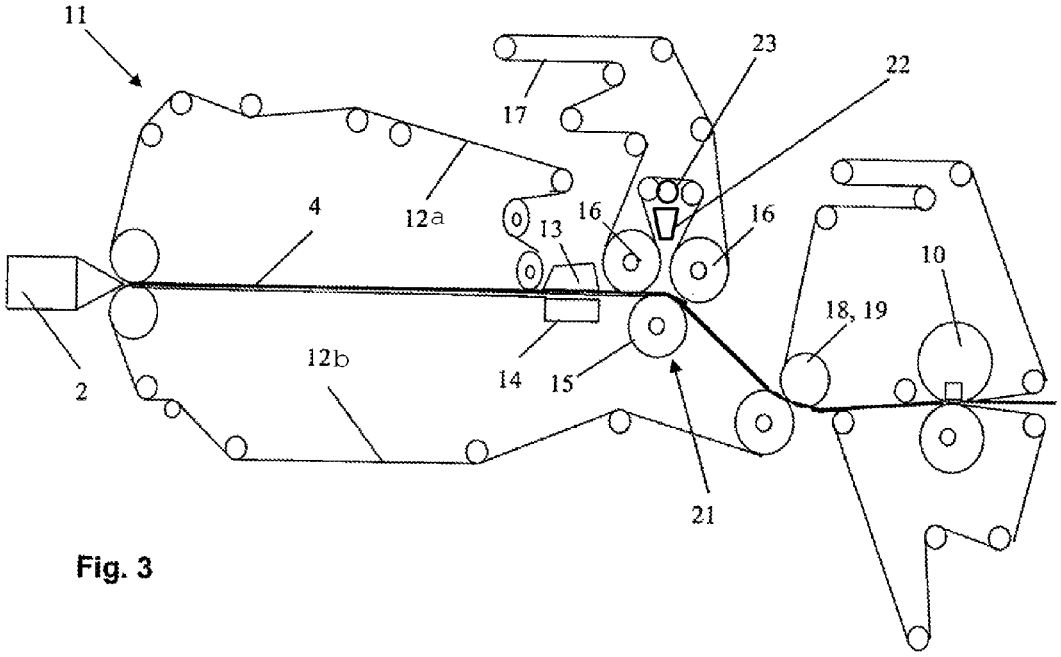
FIG. 3 shows a further variant of the dewatering device according to the invention.

FIG. 2 shows the dewatering device 11 according to the invention. Here too, a fibrous stock suspension is sprayed in between the two wire conveyors 12*a* and 12*b* via a headbox 2. The first press 21 is configured as a double nip press. It therefore comprises three rolls 15, 16, namely a wire roll 15 and two couch rolls 16. The two couch rolls 16 bear against the wire roll 15 and thus form a first nip and a second nip. The wire roll 15 is preferably evacuated and is wrapped around by the wire conveyor 12*b*. In the present example, the two couch rolls 16 are wrapped around by a common felt 17, but it is also conceivable that each couch roll 16 is wrapped around by a dedicated felt. In the present example, a tubular suction device 23 for sucking the felt 17 dry is arranged between the two couch rolls 16 in a region where the felt is separated by guide rolls from the fibrous web as shown in FIGS. 2 and 3. Moreover, a steam blower box 22 for heating the fibrous web 4 is likewise arranged between the two couch rolls 16.

A suction box 14 and a steam blower box 13 are situated upstream of the first press 21. A shoe press 10 is arranged downstream of the first press, and the fibrous web 4 is transferred here in a free run from the first press 21 into the shoe press 10.

During operation, the fibrous web 4 is dewatered downstream of the wire section by the two press nips of the first press 21, and in the process the felt 17 absorbs moisture from the fibrous web 4 in each press nip; in the case of an evacuated wire roll 15, moreover, moisture is also discharged via the wire roll 15.

FIG. 3 shows a similar dewatering device 11 to that shown in FIG. 2, but here the fibrous web 4 is transferred from the first press 21 into the following press (shown here as a shoe press 10) without a free run, that is to say with permanent web support. Here, the web transfer from the wire conveyor

12*b* to the following fabric of the shoe press 10 is carried out with the aid of a suction roll 18 or a grooved roll 19.

The invention claimed is:

1. A method for dewatering a fibrous web, comprising:

introducing a fibrous material for the formation of a fibrous web into a headbox between two wire conveyors and being dewatered, and, following the wire section, guiding the fibrous web through a plurality of presses and being dewatered, wherein the first press, through which the fibrous web is guided after the headbox, is equipped with a first and a second nip, the first press is formed by a wire roll and by two couch rolls which are in each case pressed against the wire roll in order to form the first and second nips, the wire roll being wrapped around by a wire conveyor and the couch rolls being wrapped around in each case by a common felt, and separating the common felt from the fibrous web in a region between the first and second nips, and dewatering the felt in the separated region between the first and second nips by way of a tubular suction device.

2. The method as claimed in claim 1, wherein the fibrous web is transferred without a loose run from the first press into a following shoe press, the web transfer being carried out with the aid of a suction roll or a grooved roll.

3. The method as claimed in claim 1, wherein the fibrous web is heated between the first and the second nip of the first press by a steam blower box.

4. A device for dewatering a fibrous web, comprising:

a headbox, a wire section comprising two wire conveyors, at least one first press, through which the fibrous web is guided, being arranged downstream of the wire section, wherein the first press comprises a first and a second nip, formed by a wire roll and by two couch rolls which are in each case pressed against the wire roll in order to form a nip, the wire roll being wrapped around by a wire conveyor, and the couch rolls being wrapped around in each case by a common felt, guide rolls supporting the common felt separated from the fibrous web in a region between the first and the second nip, and a tubular suction device arranged between the first and the second nip for sucking the felt to dryness while the felt is separated from the fibrous web.

5. The device as claimed in claim 4, further comprising a suction roll or a grooved roll arranged for the web transfer between the first press and a following shoe press.

6. The device as claimed in claim 4, further comprising a steam blower box installed between the first and second nip of the first press.

* * * * *